US005365616A

United States Patent [19]

Morad

[11] Patent Number: 5,365,616

[45] Date of Patent: Nov. 22, 1994

[54] NON-SPLASHING URINAL DEODORANT BLOCK HOLDER

[75] Inventor: Fred I. Morad, Toluca Lake, Calif.

[73] Assignee: Worldwide Integrated Resources, Glendale, Calif.

[21] Appl. No.: 107,304

[22] Filed: Aug. 17, 1993

[51] Int. Cl.[5] ..... E03D 9/02

[52] U.S. Cl. ..... 4/309; 4/222

[58] Field of Search ..... 4/222, 232, 309, DIG. 5, 4/222.1; 422/261, 265, 266

[56] References Cited

U.S. PATENT DOCUMENTS

| | | | |
|---|---|---|---|
| D. 258,472 | 3/1981 | Adam | 4/661 |
| 3,597,772 | 8/1971 | Leavitt | 4/222 |
| 3,824,633 | 7/1974 | Van Vlahakis | 4/222 |
| 4,103,367 | 8/1978 | Kaufer | 4/309 |
| 4,135,261 | 1/1979 | Uhrman | 4/309 |
| 4,574,400 | 3/1986 | Annowsky | 4/309 |
| 4,574,403 | 3/1986 | Dintemann et al. | 4/309 |
| 4,615,054 | 10/1986 | Beucheler et al. | 4/222.1 |
| 5,165,119 | 11/1992 | Yamato | 4/309 |

*Primary Examiner*—Henry J. Recla
*Assistant Examiner*—Gregory M. Vidovich
*Attorney, Agent, or Firm*—Thomas I. Rozsa; Tony D. Chen

[57] ABSTRACT

A non-splashing urinal deodorant block holder is used in a vertical type toilet or urinal. The urinal deodorant block holder can hold a deodorant block to rid the urinal of the unpleasant odor of urine and will not splash back the urine when the urine strikes the non-splashing urinal deodorant block holder.

4 Claims, 1 Drawing Sheet

NON-SPLASHING URINAL DEODORANT BLOCK HOLDER

BACKGROUND OF THE INVENTION

1. Field of The Invention

The present invention relates to the field of urinal deodorant block holders. In particular, the present invention is a non-splashing urinal deodorant block holder used in a vertical type urinal.

2. Description of The Prior Art

Part of the problem which the present invention addresses is that the prior art urinal deodorant block holders have a small solid flat central piece molded on the top of the holder. When a person urinates, the urine strikes the small solid flat central piece and splashes back at the person, thereby causing his hands and clothing to become wet. This is where the present invention comes into play.

Therefore, it will be desirable to have a deodorant block holder which does not have the central solid flat piece so that the urine will not splash back at the person urinating.

SUMMARY OF THE INVENTION

The present invention is a non-splashing urinal deodorant block holder used in a vertical type toilet or urinal. The present invention provides a device that will not cause the urine to splash back at the person when the urine strikes the non-splashing urinal deodorant block holder. The present invention can also hold a deodorizer block to rid the urinal of the unpleasant odor or urine in the toilet.

It has been discovered, according to the present invention, that by removing the central solid flat piece from the deodorant holder, it will provide a device that will not splash back at the person urinating.

It is therefore an object of the present invention to provide a non-splash urinal deodorant block holder, so that the urine will not splash back at the person urinating when the urine strikes the device.

It is an additional object of the present invention to provide a non-splash urinal deodorant block holder so that the device can retain the deodorant block to rid the urinal of the unpleasant odor.

In general, the uniqueness of the present invention is that the central solid flat piece of the non-splashing urinal deodorant block holder is eliminated.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
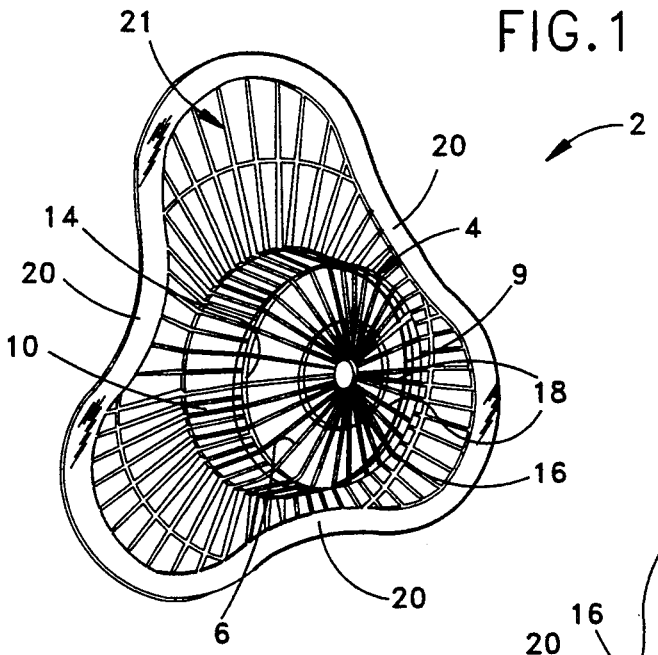
FIG. 1 is a perspective view of the present invention non-splashing urinal deodorant block holder.
Figure 2:
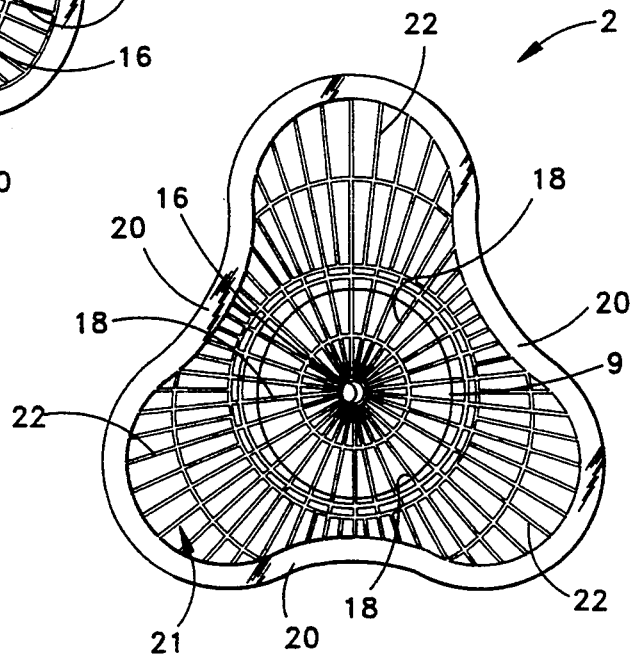
FIG. 2 is a top plan view of the present invention non-splashing urinal deodorant block holder.
Figure 3:
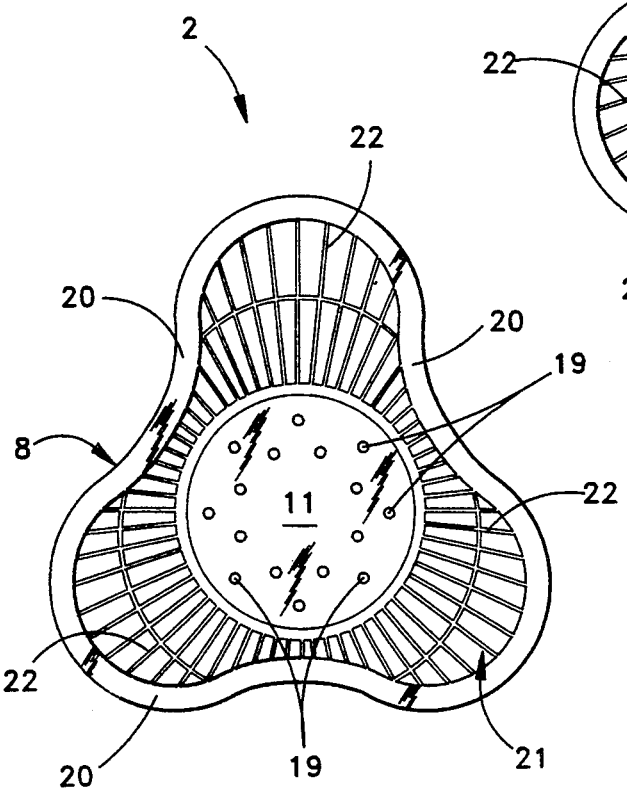
FIG. 3 is a bottom plan view of the present invention non-splashing urinal deodorant block holder.

Referring to FIGS. 1, 2 and 3, there is shown at 2 a non-splashing urinal deodorant block holder used in a vertical type toilet or urinal for minimizing the splashing of urine in the toilet. The non-splashing urinal deodorant block holder 2 generally has a mesh body or grid body 4. The mesh body or grid body 4 comprises a circular top 6, a base 8 and a cylindrical circumferential sidewall 10. The base 8 includes a central portion 11 which is molded with the cylindrical circumferential sidewall 10 and the cylindrical circumferential sidewall 10 is molded to the circular top 6. An interior chamber 14 is defined by the circular top 6, the central portion 11 of the base 8 and the cylindrical circumferential sidewall 10. The interior chamber 14 is utilized for holding a deodorant block 9 to rid the urinal of the unpleasant odor of urine. The circular top 6 of the mesh body 4 has a small circular central opening 16 and a multiplicity of slot openings 18 which extend from the small circular central opening 16 in a radial direction for allowing urine to flow therethrough. The circular central portion 11 of the base 8 of the mesh body 4 has a multiplicity of small openings 19. The base 8 also has a bottom support 21 shaped with three arches 20 with a multiplicity of slot openings 22 which extend outwardly from the central portion 11.

In operation, the non-splashing deodorant block holder 2 is placed inside the vertical type toilet. When the urine strikes the small circular central opening 16 at the circular top 6 of the mesh body 4, the urine will flow through the top 6 and the central opening 16 very substantially reducing the splashing of the urine. While the addition of the small hole 16 may seem to be a minor addition to the urinal deodorant block holder 2, it is in fact a very significant and substantial improvement because of its effect of eliminating or very substantially reducing the backsplash of urine when the urine strikes the urinal deodorant block holder 2.

The non-splashing urinal deodorant block holder 2 is manufactured with an elongated stem (not shown) formed at the circular top 6 of the mesh body 4. The present invention utilizes a method of eliminating the elongated stem (not shown) from the circular top 6 of the mesh body 4 by cutting-off the elongated stem from the circular top 6 of the mesh body 4.

The present invention can be made from several materials. The manufacturing process which could accommodate the construction of the non-splashing urinal deodorant block holder 2 may be injection, thermoform, etc. or other molding process. By way of example, the non-splashing deodorant block holder 2 can be made of plastic material. The molding and mass production process would enable the non-splashing urinal deodorant block holder to be produced inexpensively.

The unique feature of the present invention is that the small circular central opening 16 on the circular top 6 will minimize the splashing of the urine.

Defined in detail, the present invention is a non-splashing urinal deodorant block holder used in a vertical type toilet for minimizing the splashing of urine, comprising: (a) a plastic mesh body having a circular top, a base and a cylindrical circumferential sidewall; (b) an interior chamber defined by said circular top, a circular central portion of said base and said cylindrical circumferential sidewall for holding a deodorizer; (c) said circular top of said mesh body having a small circular central opening and a multiplicity of slot openings extending from the small circular central opening in a radial direction; and (d) said circular central portion of said base of said mesh body having a multiplicity of small openings, and said base having a bottom support shaped with three arches and a multiplicity of slot openings extending outwardly from said circular central portion; (e) whereby when the urine strikes said small central opening at said circular top of said mesh body, said urine will flow through said circular top, thereby minimizing the splashing of said urine.

Defined broadly, the present invention is a non-splashing urinal deodorant block holder used in a toilet for minimizing the splashing of urine, comprising: (a) a grid body having an interior chamber with a top, a base and a sidewall, where the top, the base and the sidewall define an interior chamber for holding a deodorizer; (b) said top of said grid body having a central opening and a multiplicity of slot openings extending from the central opening in a radial direction; and (c) said base of said grid body having a multiplicity of small openings; (d) whereby when the urine strikes said central opening at said top of said grid body, said urine will flow through said top, therefore minimizes the splashing of said urine.

Also defined in detail, the present invention is a method of minimizing the splashing of urine in a vertical toilet, the method comprising the steps of: (a) molding a plastic mesh body having a circular top, a base and a cylindrical circumferential sidewall; (b) forming an interior chamber defined by said circular top, a circular central portion of said base and said cylindrical circumferential sidewall for holding a deodorizer; and (c) cutting-off an elongated stem formed during said molding from said circular top of said mesh body at a central location and leaving a small circular central opening thereof; (d) whereby when the urine strikes said small central opening at said circular top of said mesh body, said urine will flow through said circular too, therefore minimizes the splashing of said urine.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A non-splashing urinal deodorant block holder used in a urinal for minimizing the splashing of urine, comprising:

a. a plastic mesh body having a circular top, a base and a cylindrical circumferential sidewall, where the circular top, the base and the cylindrical circumferential sidewall are molded together, the base having a circular central portion;

b. said circular top, said circular central portion of said base and said cylindrical circumferential sidewall define an interior chamber for holding a deodorant block;

c. said circular top of said mesh body having a small circular central opening and a multiplicity of slot openings extending from the small circular central opening in a radial direction; and d. said circular central portion of said base of said mesh body having a multiplicity of small openings, and said base having a bottom support shaped with three arches and a multiplicity of slot openings extending outwardly from said circular central portion of said base;

e. whereby when the urine strikes said small circular central opening at said circular top of said mesh body, said urine will flow through said circular top, thereby minimizing the splashing of said urine.

2. A non-splashing urinal deodorant block holder used in a urinal for minimizing the splashing of urine, comprising:

a. a plastic grid body having a top, a base and a sidewall, wherein the top, the base and the sidewall are molded together and define an interior chamber for holding a deodorant block;

b. said top of said grid body having a central opening and a multiplicity of slot openings extending from the central opening in a radial direction; and c. said base of said grid body having a multiplicity of small openings;

d. whereby when the urine strikes said central opening at said top of said grid body, said urine will flow through said top, thereby minimizing the splashing of said urine.

3. The invention as defined in claim 2 wherein said top and a central portion of said base are generally circular shaped.

4. The invention as defined in claim 3 wherein said base further has a bottom support shaped with three arches and a multiplicity of slot openings extending outwardly from said central portion.

* * * * *